US006350551B1

(12) United States Patent
Sata et al.

(10) Patent No.: US 6,350,551 B1
(45) Date of Patent: Feb. 26, 2002

(54) YELLOW TONER

(75) Inventors: Shinichi Sata; Eiji Shirai, both of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/645,362

(22) Filed: Aug. 25, 2000

(30) Foreign Application Priority Data

Aug. 25, 1999 (JP) ..... 11-238863
Aug. 25, 1999 (JP) ..... 11-238864

(51) Int. Cl.[7] ..... G03G 9/09

(52) U.S. Cl. ..... 430/108.21; 430/108.3; 430/108.7

(58) Field of Search ..... 430/106, 110, 430/109, 108.21, 108.3, 109.4, 108.7

(56) References Cited

U.S. PATENT DOCUMENTS 5,827,632 A * 10/1998 Inaba et al. ..... 430/110
5,843,605 A * 12/1998 Anno et al. ..... 430/106
5,866,288 A * 2/1999 Ciccarelli et al. ..... 430/106
5,998,079 A * 12/1999 Thompson ..... 430/110
6,106,986 A * 8/2000 Shirai et al. ..... 430/111

FOREIGN PATENT DOCUMENTS

JP A6118715 4/1994
JP A6332261 12/1994
JP A7053612 2/1995
JP A8036275 2/1996
JP A8262800 10/1996
JP A8292604 11/1996
JP A9166889 3/1997
JP A10268570 10/1998

* cited by examiner

*Primary Examiner*—Christopher Rodee
(74) *Attorney, Agent, or Firm*—Birch, Stewart, Kolasch & Birch, LLP

(57) ABSTRACT

A yellow toner comprising fine resin particles and an external additive being added to surfaces of the fine resin particles, wherein the fine resin particles comprise (a) a resin binder comprising a polyester obtained by polycondensing an alcohol component comprising a compound represented by the formula (I), with a carboxylic acid component comprising a dicarboxylic acid compound and a tricarboxylic or higher polycarboxylic acid compound; (b) a colorant comprising a compound represented by the formula (II); and (c) a charge control agent comprising a compound selected from the group consisting of metal compounds of a salicylic acid derivative represented by the formula (III); and metal compounds of a benzilic acid derivative represented by the formula (IV); and wherein the external additive comprises silica having an average particle size of from 35 to 350 nm.

8 Claims, No Drawings

YELLOW TONER

BACKGROUND OF THE INVENTION

1. Field of the Invention

The present invention relates to a yellow toner used for development of electrostatic images formed in electrophotography, electrostatic recording, electrostatic printing, or the like.

2. Discussion of the Related Art

As a yellow toner, a toner containing a dichlorobenzidine pigment such as Pigment Yellow 17 as a colorant has been used. However, in the toner, the changes in hue by continuous printing are large depending upon the kinds of the charge control agent contained. Moreover, since dichlorobenzidine is listed as one of the environmental label Blue Angel regulation in Eco-marks in Germany, there has been expected a development of a yellow toner using a colorant without containing the dichlorobenzidine pigment.

Therefore, there has been reported a toner containing Pigment Yellow 185 excellent in the heat resistance in Japanese Patent Laid-Open No. Hei 6-118715. However, in order to obtain a more excellent toner for practical purposes, the toner is required to satisfy various properties such as environmental stability or color reproducibility, fixing ability, and changes in hues.

An object of the present invention is to provide a yellow toner having excellent environmental stability, color reproducibility, and fixing ability, and being less likely to undergo changes in hue, even when subjected to continuous printing.

The above and other objects of the present invention will be apparent from the following description.

SUMMARY OF THE INVENTION

The present invention relates to a yellow toner comprising fine resin particles and an external additive being added to surfaces of the fine resin particles, wherein the fine resin particles comprise:

(a) a resin binder comprising a polyester obtained by polycondensing an alcohol component comprising a compound represented by the formula (I):

(I)

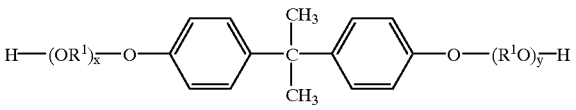

wherein $R^1$ is an alkylene group having 2 or 3 carbon atoms; each of x and y is a positive number, wherein a sum of x and y is 1 to 16, with a carboxylic acid component comprising a dicarboxylic acid compound and a tricarboxylic or higher polycarboxylic acid compound;

(b) a colorant comprising a compound represented by the formula (II):

(II)

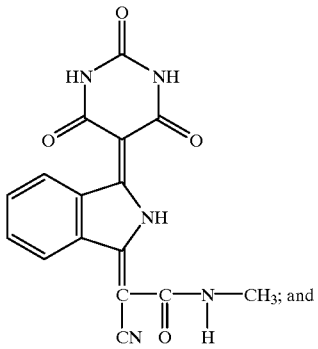

(c) a charge control agent comprising a compound selected from the group consisting of metal compounds of a salicylic acid derivative represented by the formula (III):

(III)

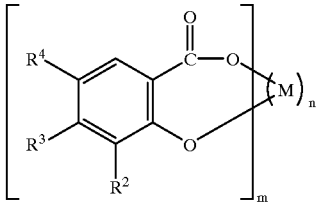

wherein each of $R^2$, $R^3$, and $R^4$ is independently hydrogen atom, a linear or branched alkyl group having 1 to 10 carbon atoms, or allyl group; M is zinc, zirconium, chromium, aluminum, copper, nickel, or cobalt; m is an integer of 2 or more; and n is an integer of 1 or more; and metal compounds of a benzilic acid derivative represented by the formula (IV):

(IV)

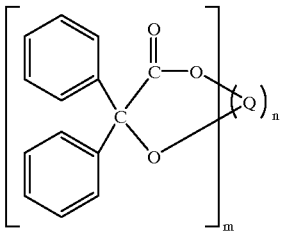

wherein Q is boron or aluminum; m is an integer of 2 or more; and n is an integer of 1 or more; and wherein the external additive comprises silica having an average particle size of from 35 to 350 nm.

DETAILED DESCRIPTION OF THE INVENTION

The resin binder in the present invention comprises a polyester obtained by polycondensing an alcohol component comprising a compound represented by the formula (I):

(I)

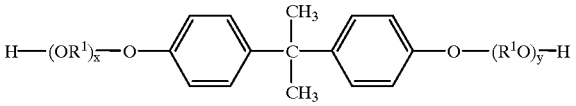

wherein $R^1$ is an alkylene group having 2 or 3 carbon atoms; each of x and y is a positive number, wherein a sum of x and y is 1 to 16, preferably 1.5 to 5.0, with a carboxylic acid component comprising a dicarboxylic acid compound and a tricarboxylic or higher polycarboxylic acid compound.

The compound represented by the formula (I) includes alkylene(2 to 3 carbon atoms) oxide(average moles added 1 to 16) adduct of bisphenol A such as polyoxypropylene(2.2)-2,2-bis(4-hydroxyphenyl)propane and polyoxyethylene (2.0)-2,2-bis(4-hydroxyphenyl)propane. In addition, other alcohol components include ethylene glycol, propylene glycol, glycerol, pentaerythritol, trimethylolpropane, hydrogenated bisphenol A, sorbitol, or alkylene oxide(average moles added 1 to 16) adducts thereof, of which alkylene moiety has 2 to 4 carbon atoms. These compounds may be used alone or in admixture of two or more kinds.

It is desired that the compound represented by the formula (I) is contained in an amount of 5% by mol or more, preferably 50% by mol or more, more preferably 100% by mol or more, of the alcohol component.

The dicarboxylic acid compound includes dicarboxylic acids such as phthalic acid, isophthalic acid, terephthalic acid, fumaric acid, and maleic acid; succinic acids substituted by an alkyl group having 1 to 20 carbon atoms or by an alkenyl group having 2 to 20 carbon atoms, such as dodecenylsuccinic acid and octylsuccinic acid; acid anhydrides thereof, alkyl(1 to 8 carbon atoms) esters of these acids, and the like.

The tricarboxylic or higher polycarboxylic acid compound includes trimellitic acid, pyromellitic acid, acid anhydrides thereof, alkyl(1 to 8 carbon atoms) esters of these acids, and the like.

The dicarboxylic acid compound is contained in an amount of preferably from 70 to 99.95% by mol, more preferably from 70 to 90% by mol, of the carboxylic acid component. In addition, the tricarboxylic or higher polycarboxylic acid compound is contained in an amount of preferably from 0.05 to 30% by mol, more preferably from 10 to 30% by mol, of the carboxylic acid component.

The polycondensation of the alcohol component with the carboxylic acid component is carried out, for instance, by the reaction at a temperature of from 180° to 250° C. in an inert gas atmosphere, using an esterification catalyst as occasion demands.

It is preferable that the polyester has an acid value of from 0.1 to 55 mg KOH/g, a hydroxyl value of from 15 to 50 mg KOH/g, a softening point of from 90° to 140° C., and a glass transition temperature of 50° to 70° C., respectively.

In the present invention, the resin binder may comprise a linear polyester obtained without using a tricarboxylic or higher polycarboxylic acid compound. It is desired that such a linear polyester is used so that the polyester obtained from the above tricarboxylic or higher polycarboxylic acid compound is contained in an amount of 30% by weight or more, preferably 50% by weight or more, more preferably 100% by weight, of the resin binder.

The colorant in the present invention comprises a compound represented by the formula (II):

(II)

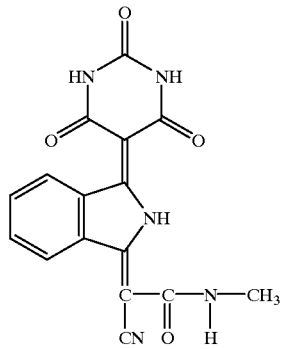

As the colorant, there can be used commercially available products such as "Paliotol Yellow D1155" (commercially available from BASF).

The compound represented by the formula (II) is contained in an amount of preferably from 1 to 25 parts by weight, more preferably from 2.5 to 5.0 parts by weight, based on 100 parts by weight of the resin binder.

The charge control agent in the present invention comprises a compound selected from the group consisting of metal compounds of a salicylic acid derivative represented by the formula (III):

(III)

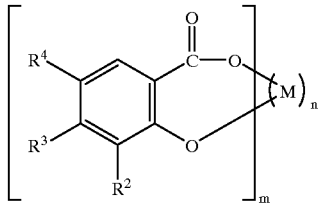

wherein each of $R^2$, $R^3$, and $R^4$ is independently hydrogen atom, a linear or branched alkyl group having 1 to 10 carbon atoms, or allyl group; M is zinc, zirconium, chromium, aluminum, copper, nickel, or cobalt; m is an integer of 2 or more; and n is an integer of 1 or more; and metal compounds of a benzilic acid derivative represented by the formula (IV):

(IV)

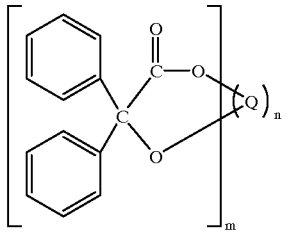

wherein Q is boron or aluminum; m is an integer of 2 or more; and n is an integer of 1 or more.

Here, the metal compound may be either a metal salt or a metal complex. By the use of the metal compound of the formula (III), the resulting yellow toner is imparted with remarkably excellent environmental stability, and by the use of the metal compound of the formula (IV), the resulting yellow toner is imparted with remarkably excellent color reproducibility.

In the formula (III), $R^3$ is preferably hydrogen atom, and each of $R^2$ and $R^4$ is preferably a branched alkyl group having 3 to 10 carbon atoms, more preferably tert-butyl group.

Among zinc, zirconium, chromium, aluminum, copper, nickel, and cobalt which are represented by M, zinc, zirconium and chromium which have an excellent effect of imparting chargeability are preferable, and zinc and zirconium are more preferable.

Commercially available products which are suitably used in the present invention where $R^3$ is hydrogen atom, each of $R^2$ and $R^4$ is tert-butyl group include "BONTRON E-84" (M: zinc; commercially available from Orient Chemical Co., Ltd.); "TN-105" (M: zirconium; commercially available from Hodogaya Chemical Industries); "BONTRON E-81" (M: chromium; commercially available from Orient Chemical Co., Ltd.), and the like.

In addition, the metal compounds of a salicylic acid derivative can be readily prepared in accordance with the method described in CLARK, J. L. and KAO, H. (1948), *J. Amer. Chem. Soc.* 70, 2151. For instance, the metal compound can be obtained as a zinc compound by combining and mixing 2 moles of sodium salt of salicylic acid (containing sodium salt of salicylic acid derivatives) with 1 mole of zinc chloride in a solvent, and stirring the mixture with heating. This metal compound is crystals showing a white color, so that it does not cause coloration when dispersed in the resin binder. Metal compounds other than the zinc compound can be prepared by a method similar to that described above.

The metal compound of a salicylic acid derivative, based on 100 parts by weight of the resin binder, is contained in an amount of preferably 0.5 parts by weight or more, from the viewpoint of improving the triboelectic chargeability, and the metal salt compound is contained in an amount of preferably 10 parts by weight or less, from the viewpoint of preventing detachment of the charge control agent, more preferably from 1 to 5 parts by weight.

Commercially available products of the metal salt compound of a benzilic acid derivative represented by the formula (IV) include "LR147" (Q: boron; commercially available from Japan Carlit); "LR-297" (Q: aluminum; commercially available from Japan Carlit), and the like.

The metal salt compound of a benzilic acid derivative, based on 100 parts by weight of the resin binder, is contained in an amount of 0.3 parts by weight or more, from the viewpoint of improving the charging ratio of triboelectric charging, and the content is preferably 3 parts by weight or less, from the viewpoint of preventing lowering of the level of triboelectric charges by electroconductivity of the charge control agent, more preferably from 0.5 to 2 parts by weight.

In the present invention, as a charge control agent, besides the metal compound of a salicylic acid derivative or the metal salt compound of a benzilic acid derivative, a usually employed charge control agent can be also used together therewith.

The external additive in the present invention comprises a silica. In the present invention, it is preferable that at least one silica used as an external additive is one subjected to hydrophobic treatment with an organic silicon compound having an organic group such as trimethyl group.

The silica has an average particle size of from 35 to 350 nm, preferably from 35 to 100 nm. When a silica having a relatively large particle size as specified above is externally added, the movement of the toner is regulated during transferring, whereby clear images can be formed even when transferring is carried out a plurality of times. Incidentally, in the present invention, the particle size of the silica is obtained by using a scanning electron microscope or transmission electron microscope.

The silica having an average particle size of from 35 to 350 nm is contained in an amount of preferably from 0.1 to 5 parts by weight, more preferably 0.3 to 3 parts by weight, based on 100 parts by weight of the fine resin particles.

In the present invention, a silica having a small particle size with an average particle size of less than 35 nm, preferably 8 nm or more and less than 35 nm, more preferably from 10 to 18 nm may be fierier externally added to surfaces of the fine resin particles.

In the present invention, a commercially available product used as a silica having a large particle size includes "NAX-50" (commercially available from Nippon Aerosil; hydrophobic silica; average particle size: 35 nm), and the like, and commercially available products used as a silica having a small particle size include "R-972" (commercially available from Nippon Aerosil; hydrophobic silica; average particle size: 16 mn); "R-974" (commercially available from Nippon Aerosil; hydrophobic silica; average particle size: 12 nm), and the like.

The toner of the present invention is not particularly limited, and includes pulverized toners, polymerization toners, encapsulated toners, and the like. For instance, the toner can be prepared by adding an external additive to fine resin particles obtained by known methods such as kneading and pulverization method, spray-drying method, and polymerization method. As a general method, for instance, a resin binder, a colorant, a charge control agent, and the like are homogeneously blended in a mixer such as a ball-mill, and thereafter the mixture is melt-kneaded by a seal-type kneader or a single-screw or twin-screw extruder, or the like, and the kneaded mixture is cooled, pulverized, and classified, to give fine resin particles. Thereafter, the resulting fine resin particles are mixed with an external additive with stirring by using a high-speed agitating device such as Super Mixer and Henschel mixer, thereby allowing to deposit the external additive on the surface of the fine resin particles, to give a toner of the present invention. It is preferable that the toner of the present invention has a weight-average particle size of from 3 to 10 $\mu$m.

Incidentally, in the toner of the present invention, there may be added in appropriate amounts additives such as a releasing agent, an electroconductive controlling agent, reinforcing fillers such as an extender and fibrous substances, an antioxidant, an anti-aging agent, and a cleaning ability improver.

The yellow toner of the present invention can be used as a nonmagnetic one-component developer when a fine magnetite particulate is not contained, or as a two-component developer by mixing the toner with a carrier. From the viewpoint of easy control of the triboelectric chargeability, it is preferably used in a nonmagnetic one-component developing device as a nonmagnetic one-component developer.

EXAMPLES

[Glass Transition Point]

Determined at a heating rate of 10° C./min by using a differential scanning calorimeter "DSC Model 210" (commercially available from Seiko Instruments, Inc.).

[Acid Value and Hydroxyl Value]

Determined in accordance with JIS K0070.

Resin Preparation Example 1

Seventy moles of polyoxypropylene(2.2)-2,2-(4-hydroxyphenyl)propane, 30 moles of polyoxyethylene(2.0)-

2,2-(4-hydroxyphenyl)propane, 50 moles of terephthalic acid, 25 moles of an alkenylsuccinic acid, 25 moles of trimellitic acid, and 15 g of dibutyltin oxide were reacted at 230° C. with stirring under nitrogen atmosphere until the softening point as determined by a method in accordance with ASTM E28-67 reached 121° C., to give Resin A. Resin A had a glass transition temperature of 61° C., an acid value of 32.1 mg KOH/g, and a hydroxyl value of 34.0 mg KOH/g.

Resin Preparation Example 2

The same procedures as in Resin Preparation Example 1 were carried out, except for using 35 moles of polyoxypropylene(2.2)-2,2-(4-hydroxyphenyl)propane, 65 moles of polyoxyethylene(2.0)-2,2-(4-hydroxyphenyl) propane, 90 moles of terephthalic acid, and 15 g of dibutyltin oxide, to give Resin B. Resin B had a glass transition temperature of 66° C., an acid value of 3.44 mg KOH/g, and a hydroxyl value of 23.4 mg KOH/g.

Example 1-1

There were blended together using a Henschel mixer 93.5 parts by weight of Resin A as a resin binder, 3.5 parts by weight of "Paliotol Yellow D1155" (commercially available from BASF) as a colorant, 1.5 parts by weight of "BONTRON E-84" (commercially available from Orient Chemical Co., Ltd.) as a charge control agent, and 1.5 parts by weight of a polypropylene wax "Mitsui Hiwax NP-105" (commercially available from Mitsui Chemical) as a releasing agent. Thereafter, the resulting mixture was melt-kneaded with a twin-screw extruder, and the kneaded mixture was pulverized and classified using an IDS (commercially available from Nippon Pneumatic Kogyo K.K.), to give fine resin particles having a weight-average particle size of 8.4 μm and a variation coefficient of 26.0%.

To 100 parts by weight of the resulting fine resin particles was added 2.5 parts by weight of a hydrophobic silica "NAX-50" (commercially available from Nippon Aerosil, average particle size: 35 nm), and the mixture was stined in a 10-liter Henschel mixer at 3200 r/min for 180 sec, to give a yellow toner.

Example 1-2

The same procedures as in Example 1-1 were carried out, except for using 1.5 parts by weight of "BONTRON E-81" (commercially available from Orient Chemical Co., Ltd.) in place of "BONTRON E-84" as a charge control agent, to give fine resin particles having a weight-average particle size of 8.5 μm and a variation coefficient of 25.1%, thereby giving a yellow toner.

Example 1-3

The same procedures as in Example 1-1 were carried out, except for using 47 parts by weight of Resin A and 46.5 parts by weight of Resin B in place of 93.5 parts by weight of Resin A, to give fine resin particles having a weight-average particle size of 8.5 μm and a variation coefficient of 25.3%, thereby giving a yellow toner.

Example 1-4

The same procedures as in Example 1-1 were carried out, except for using 1.5 parts by weight of "TN-105" (commercially available from Hodogaya Chemical Industries) in place of "BONTRON E-84" as a charge control agent, to give fine resin particles having a weight-average particle size of 8.5 μm and a variation coefficient of 24.8%, thereby giving a yellow toner.

Comparative Example 1-1

The same procedures as in Example 1-1 were carried out, except for using 3.5 parts by weight of a dichlorobenzidine pigment "ECY-215" (commercially available from DAINICHISEIKA COLOR & CHEMICALS MFG. CO., LTD.) in place of "Paliotol Yellow D1155" as a colorant, to give fine resin particles having a weight-average particle size of 8.5 μm and a variation coefficient of 25.3%, thereby giving a yellow toner.

Comparative Example 1-2

The same procedures as in Example 1-1 were cared out, except for using 1.5 part by weight of "T-77" (commercially available from Hodogaya Chemical Industries), a metal-azo complex, in place of "BONTRON E-84" as a charge control agent, to give fine resin particles having a weight-average particle size of 8.5 μm and a variation coefficient of 25.5%, thereby giving a yellow toner. The resulting yellow toner had a hue notably departing from yellow, having a dark color.

Comparative Example 1-3

The same procedures as in Example 1-1 were carried out, except for using 93.5 parts by weight of Resin B in place of Resin A, to give fine resin particles having a weight-average particle size of 8.5 μm and a variation coefficient of 25.0%, thereby giving a yellow toner.

Comparative Example 1-4

The same procedures as in Example 1-1 were carried out, except for using 0.5 parts by weight of "R-974" (commercially available from Nippon Aerosil; average particle size: 12 nm) in place of "NAX-50" as a hydrophobic silica, thereby giving a yellow toner.

Example 2-1

There were blended together using a Henschel mixer 93.5 parts by weight of Resin A as a resin binder, 3.5 parts by weight of "Paliotol Yellow D1155" (commercially available from BASF) as a colorant, 1.5 parts by weight of "LR-147" (commercially available from Japan Carlit) as a charge control agent, and 1.5 parts by weight of a "Carnauba Wax C1" (product imported by Kato Yoko) as a releasing agent. Thereafter, the resulting mixture was melt-kneaded with a twin-screw extruder, and the kneaded mixture was pulverized and classified using an IDS (commercially available from Nippon Pneumatic Kogyo K.K.), to give fine resin particles having a weight-average particle size of 8.5 μm and a variation coefficient of 25.4%.

To 100 parts by weight of the resulting fine resin particles was added 2.5 parts by weight of a hydrophobic silica "NAX-50" (commercially available from Nippon Aerosil, average particle size: 35 nm), and the mixture was stirred in a 10-liter Henschel mixer at 3200 r/min for 180 sec, to give a yellow toner.

Example 2-2

The same procedures as in Example 2-1 were carried out, except for using 1.5 parts by weight of "LR-297" (commercially available from Japan Carlit) in place of "LR-147" as a charge control agent, to give fine resin particles having a weight-average particle size of 8.5 μm and a variation coefficient of 25.6%, thereby giving a yellow toner.

Example 2-3

The same procedures as in Example 2-1 were carried out, except for using 47 parts by weight of Resin A and 46.5 parts by weight of Resin B in place of 93.5 parts by weight of Resin A, to give fine resin particles having a weight-average particle size of 8.5 μm and a variation coefficient of 25.5%, thereby giving a yellow toner.

Comparative Example 2-1

The same procedures as in Example 2-1 were carried out, except for using 3.5 parts by weight of a dichlorobenzidine pigment "ECY-215" (commercially a available from DAINICHISEIKA COLOR & CHEMICALS MFG. CO., LTD.) in place of "Paliotol Yellow D1155" as a colorant, to give fine resin particles having a weight-average particle size of 8.5 μm and a variation coefficient of 25.3%, thereby giving a yellow toner.

Comparative Example 2-2

The same procedures as in Example 2-1 were carried out, except for using 1.5 parts by weight of "T-77" (commercially available from Hodogaya Chemical Industries), a metal-azo complex, in place of "LR-147" as a charge control agent, to give fine resin particles having a weight-average particle size of 8.5 μm and a variation coefficient of 25.5%, thereby giving a yellow toner.

Comparative Example 2-3

The same procedures as in Example 2-1 were carried out, except for using 93.5 parts by weight of Resin B in place of Resin A, to give fine resin particles having a weight-average particle size of 8.5 μm and a variation coefficient of 25.0%, thereby giving a yellow toner.

Comparative Example 2-4

The same procedures as in Example 2-1 were carried out, except for using 0.5 parts by weight of "R-974" (commercially available from Nippon Aerosil; average particle size: 12 nm) in place of "NAX-50" as a hydrophobic silica, thereby giving a yellow toner.

Each of the toners obtained in Examples 1-1 to 1-4 and Comparative Examples 1-1 to 1-4 was subjected to Test Examples 1A, 2, and 3, and each of the toners obtained in Examples 2-1 to 2-3 and Comparative Examples 2-1 to 2-4 was subjected to Test Examples 1B, 2, and 3.

Test Example 1A

A yellow toner is loaded to a nonmagnetic one-component developer device "IPSIO COLOR 2000" (commercially available from Ricoh Company Limited). Using "MODEL 210 HS Q/M meter" (commercially available from Trek INC.), the triboelectric charges on the developer sleeve were determined when the main electric power source was turned on and idling state was reached under ordinary environmental conditions (25° C., 50% RH), high-temperature, high-humidity environmental conditions (35° C., 85% RH), and low-temperature, low-humidity environmental conditions (10° C., 25% RH). An average value of the changing ratio of the triboelectric charges under high-temperature, high-humidity environmental conditions to the triboelectric charges under ordinary conditions and the triboelectric charges under low-temperature, low-humidity environmental conditions to the triboelectric charges under ordinary conditions was calculated as follows, namely:

changing ratio of triboelectric charges under high-temperature, high-humidity environmental conditions + changing ratio of triboelectric charges under low-temperature, low-humidity environmental conditions

2 and the environmental stability was evaluated in accordance with the following criteria. The results are shown in Table 1.

[Evaluation Criteria]

◎: Average value being less than 5%, particularly favorable in practical use.

○: Average value being 5% or more and less than 10%, favorable in practical use.

Δ: Average value being 10% or more and less than 15%, without any problem in practical use.

X: Average value being 15% or more, making its practical use impossible.

Test Example 1B

A yellow toner was loaded on the same device as in Test Example 1A, and solid images were printed on plain paper "XEROX 4200." The color-reproducible region of the resulting solid images was determined by using "SPECTRODENSITOMETER 938" (commercially available from X-Rite). The color reproducibility was evaluated in accordance with the following criteria. The results are shown in Table 2.

[Evaluation Criteria]

The value for $\sqrt{\{(a^*)^2+(b^*)^2\}}$:

◎: being 100 or more, particularly favorable in practical use.

○: being 90 or more and less than 100, favorable in practical use.

Δ: being 85 or more and less than 90, without any problem in practical use.

X: being less than 85, making its practical use impossible.

Test Example 2

A yellow toner was loaded on an electrophotographic device, which was a similar device to that of Test Example 1A except for taking out a fixing device and a fixing oil supplying device, to give an unfixed image. Thereafter, the resulting unfixed images were fixed externally by sequentially raising the temperature of the fixing device taken out from 100° to 220° C., and a fixable temperature region when fixing was determined to evaluate the fixing property by the following criteria. The results are shown in Tables 1 and 2.

[Evaluation Criteria]

◎: The fixable temperature region being 50° C. or more, particularly favorable in practical use.

○: The-fixable temperature region being 40° C. or more and less than 50° C., favorable in practical use.

Δ: The fixable temperature region being 30° C. or more and less than 40° C., without any problem in practical use.

X: The fixable temperature region being less than 30° C., making its practical use impossible.

Test Example 3

A yellow toner was loaded on a device similar to that of Test Example 1A, and printing was continuously carried out for 6000 sheets using plain paper "XEROX 4200" at a printing ratio per sheet of 5%. The difference in the changes in hue (ΔE) of the first sheet and the 6000th sheet was determined by using "SPECTRODENSITOMETER 938" (commercially available from X-Rite). The extent of the changes of hue was evaluated in accordance with the criteria. The results are shown in Tables 1 and 2.

[Evaluation Criteria]

◎: The ΔE being less than 2.0, particularly favorable in practical use.Δ

○: The ΔE being 2.0 or more and less than 5.0, favorable in practical use.

Δ: The ΔE being 5.0 or more and less than 10.0, without any problem in practical use.

X: The ΔE being less than 10.0, making its practical use impossible.

TABLE 1

| | Environmental Stability | Fixing Ability | Changes in Hue |
|---|---|---|---|
| Example 1-1 | ◎ | ◎ | ◎ |
| Example 1-2 | ◎ | ◎ | ○ |
| Example 1-3 | ◎ | ◎ | ○ |
| Example 1-4 | ◎ | ◎ | ◎ |
| Comparative Example 1-1 | x | ◎ | ◎ |
| Comparative Example 1-2 | ◎ | ○ | x |
| Comparative Example 1-3 | ○ | x | ◎ |
| Comparative Example 1-4 | x | ◎ | x |

TABLE 2

| | Color Reproducibility | Fixing Ability | Changes in Hue |
|---|---|---|---|
| Example 2-1 | ◎ | ◎ | ◎ |
| Example 2-2 | ◎ | ◎ | ◎ |
| Example 2-3 | ◎ | ○ | ○ |
| Comparative Example 2-1 | ○ | ◎ | x |
| Comparative Example 2-2 | x | ◎ | x |
| Comparative Example 2-3 | ○ | x | x |
| Comparative Example 2-4 | ◎ | ◎ | x |

It is clear from the above results that all of the toners of Examples 1-1 to 1-4 are excellent in the environmental stability and the fixing ability, and have small changes in hue when subjected to continuous printing, so that an excellent hue can be maintained. On the other hand, it is respectively found that the toner of Comparative Example 1-1 where a dichlorobenzidine pigment is contained is poor in the environmental stability; that the toner of Comparative Example 1-2 where a metal-azo complex is contained as a charge control agent has large changes in hue by continuous printing; that the toner of Comparative Example 1-3 where a resin binder obtained without using a tricarboxylic or higher polycarboxylic acid compound is contained is poor in the fixing ability; and that the toner of Comparative Example 1-4 where only a silica having a small particle size is added as an external additive is not only poor in the environmental stability but also has large changes in hue by continuous printing.

In addition, it is clear from the above results that all of the toners of Examples 2-1 to 2-3 are excellent in the color reproducibility and the fixing ability, and have small changes in hue when subjected to continuous printing, so that an excellent hue can be maintained. On the other hand, it is respectively found that the toner of Comparative Example 2-1, where dichlorobenzidine pigment is contained, and the toner of Comparative Example 2-4, where only silica having a small particle size is added as an external additive, have large changes in hue by continuous printing; that the toner of Comparative Example 2-2 where a metal-azo complex is contained as a charge control agent not only is poor in the color reproducibility but also has large changes in hue by continuous printing; and that the toner of Comparative Example 2-3 where a resin binder obtained without using a tricarboxylic or higher polycarboxylic acid compound is contained is not only poor in the fixing ability but also in the changes in hue.

According to the present invention, there can be provided a yellow toner which is excellent in the environmental stability, the color reproducibility and the fixing ability, and has small changes in hue when subjected to a continuous printing. In particular, by the use of the metal compound of the formula (III), the resulting yellow toner is imparted with remarkably excellent environmental stability, and by the use of the metal compound of the formula (IV), the resulting yellow toner is imparted with remarkably excellent color reproducibility.

What is claimed is:

1. A yellow toner comprising fine resin particles and an external additive being added to surfaces of the fine resin particles, wherein said fine resin particles comprise:

(a) a resin binder comprising a polyester obtained by polycondensing an alcohol component comprising a compound represented by the formula (I):

(I)

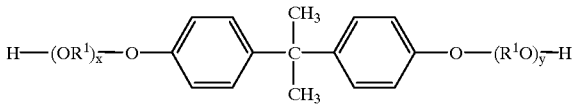

wherein $R^1$ is an alkylene group having 2 or 3 carbon atoms; each of x and y is a positive number, wherein a sum of x and y is 1 to 16, with a carboxylic acid component comprising a dicarboxylic acid compound and a tricarboxylic or higher polycarboxylic acid compound;

(b) a colorant comprising a compound represented by the formula (II):

(II)

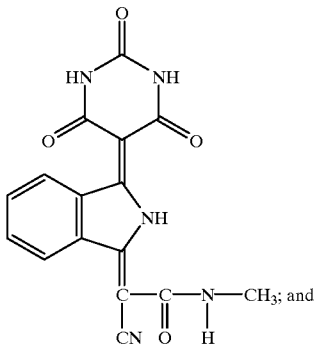

(c) a charge control agent comprising a compound selected from the group consisting of metal compounds of a salicylic acid derivative represented by the formula (III):

(III)

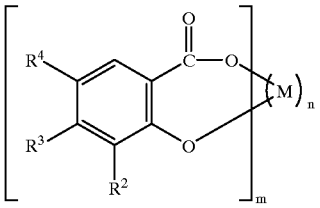

wherein each of $R^2$, $R^3$, and $R^4$ is independently hydrogen atom, a linear or branched alkyl group having 1 to 10 carbon atoms, or allyl group; M is zinc, zirconium, chromium, aluminum, copper, nickel, or cobalt; m is an integer of 2 or more; and n is an integer of 1 or more; and metal compounds of a benzilic acid derivative represented by the formula (IV):

(IV)

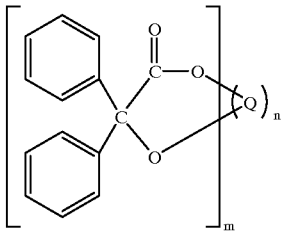

wherein Q is boron or aluminum; m is an integer of 2 or more; and n is an integer of 1 or more; and wherein the external additive comprises silica having an average particle size of from 35 to 350 nm.

2. The yellow toner according to claim 1, wherein the compound represented by the formula (I) is contained in an amount of 5 mol % or more of the alcohol component, and wherein the tricarboxylic or higher polycarboxylic acid compound is contained in an amount of from 0.05 to 30 mol % of the carboxylic acid component.

3. The yellow toner according to claim 1, which toner is a toner for a non-magnetic one-component developing device.

4. The yellow toner according to claim 1, wherein $R^3$ is hydrogen atom, each of $R^2$ and $R^4$ is a branched alkyl group having 3 to 10 carbon atoms, and M is zinc or zirconium in the formula (III).

5. The yellow toner according to claim 1, wherein the metal compound of a salicylic acid derivative is contained in an amount of 0.5 to 10 parts by weight, based on 100 parts by weight of the resin binder.

6. The yellow toner according to claim 1, wherein the metal compound of a benzilic acid derivative is contained in an amount of 0.3 to 3 parts by weight, based on 100 parts by weight of the resin binder.

7. The yellow toner according to claim 1, wherein the silica having an average particle size of from 35 to 350 nm is contained in an amount of from 0.1 to 5 parts by weight, based on 100 parts by weight of the fine resin particles.

8. The yellow toner according to claim 1, wherein silica having an average particle size of less than 35 nm is further externally added to the surfaces of the fine resin particles.

* * * * *